US008526656B2

(12) United States Patent
Tanaka et al.

(10) Patent No.: US 8,526,656 B2
(45) Date of Patent: Sep. 3, 2013

(54) MICROPHONE UNIT

(75) Inventors: Fuminori Tanaka, Osaka (JP); Ryusuke Horibe, Osaka (JP); Takeshi Inoda, Osaka (JP); Masatoshi Ono, Ibaraki (JP); Rikuo Takano, Ibaraki (JP); Toshimi Fukuoka, Kanagawa (JP)

(73) Assignees: Funai Electric Co., Ltd., Osaka (JP); Funai Electric Advanced Applied Technology Research Institute Inc., Osaka (JP)

( * ) Notice: Subject to any disclaimer, the term of this patent is extended or adjusted under 35 U.S.C. 154(b) by 311 days.

(21) Appl. No.: 12/617,837

(22) Filed: Nov. 13, 2009

(65) Prior Publication Data

US 2010/0142742 A1 Jun. 10, 2010

(30) Foreign Application Priority Data

Dec. 5, 2008 (JP) ..... 2008-310502

(51) Int. Cl.
*H04R 1/02* (2006.01)
*H04R 11/04* (2006.01)

(52) U.S. Cl.
USPC ..... 381/346; 381/360; 381/163; 381/355; 381/356; 381/387

(58) Field of Classification Search
USPC ..... 381/328, 322, 191, 369, 346, 174, 381/359, 111, 92, 163, 355, 356, 387
See application file for complete search history.

(56) References Cited

U.S. PATENT DOCUMENTS

| | | | | |
|---|---|---|---|---|
| 3,876,843 | A * | 4/1975 | Moen | 381/313 |
| 5,703,957 | A * | 12/1997 | McAteer | 381/92 |
| 2003/0064687 | A1* | 4/2003 | Sugino et al. | 455/90 |
| 2004/0114775 | A1* | 6/2004 | Chang | 381/191 |
| 2005/0207605 | A1* | 9/2005 | Dehe et al. | 381/369 |

(Continued)

FOREIGN PATENT DOCUMENTS

| | | |
|---|---|---|
| JP | 04-217199 | 8/1992 |
| JP | 2000-050386 A | 2/2000 |

(Continued)

OTHER PUBLICATIONS

Japanese Office Action mailed Jul. 23, 2013 in corresponding Japanese application No. 2008-310502.

*Primary Examiner* — Duc Nguyen
*Assistant Examiner* — Phan Le
(74) *Attorney, Agent, or Firm* — Morgan, Lewis & Bockius LLP

(57) ABSTRACT

A microphone unit includes: a housing; a diaphragm which is disposed in the inside of the housing; and an electric circuit portion which processes an electric signal that is generated based on a vibration of the diaphragm. In the housing, a first sound guide space which guides a sound outside the housing to a first surface of the diaphragm via a first sound hole and a second sound guide space which guides a sound outside the housing to a second surface, that is, an opposite surface of the diaphragm via a second sound hole are formed. The electric circuit portion is disposed in either one of the first sound guide space and the second sound guide space; and an acoustic resistance portion which adjusts at least one of a frequency characteristic of the first sound guide space and a frequency characteristic of the second sound guide space is formed.

11 Claims, 5 Drawing Sheets

(56) References Cited

U.S. PATENT DOCUMENTS

| | | | | |
|---|---|---|---|---|
| 2006/0227990 | A1* | 10/2006 | Kirchhoefer | 381/328 |
| 2006/0239475 | A1* | 10/2006 | Kubota | 381/111 |
| 2007/0121967 | A1* | 5/2007 | Sjursen et al. | 381/111 |
| 2008/0166000 | A1* | 7/2008 | Hsiao | 381/361 |
| 2008/0247587 | A1* | 10/2008 | Sato | 381/365 |

FOREIGN PATENT DOCUMENTS

| | | | | |
|---|---|---|---|---|
| JP | 2005-295278 | | 10/2005 | |
| JP | 2005295278 | A * | 10/2005 | 381/191 |
| JP | 2008-258904 | A | 10/2008 | |
| JP | 2008-258998 | A | 10/2008 | |

* cited by examiner

MICROPHONE UNIT

This application is based on Japanese Patent Application No. 2008-310502 filed on Dec. 5, 2008 in Japan, the contents of which are hereby incorporated by reference.

BACKGROUND OF THE INVENTION

1. Field of the Invention

The present invention relates to a microphone unit which transduces an input voice into an electric signal, and more particularly, to a structure of a microphone unit which is so formed as to allow a sound pressure to act on both surfaces (front and rear surfaces) of a diaphragm and generates an electric signal by using a vibration of the diaphragm based on a sound pressure difference.

2. Description of Related Art

Conventionally, a microphone unit is used in, for example, voice communication devices such as a mobile phone, a transceiver and the like, or in information process systems such as a voice identification system and the like which use a technology for analyzing an input voice, or in a recording device and the like. For over-the-telephone talking, voice recognition and voice recording, it is preferable that only a target voice (user's voice) is collected. For this purpose, a microphone unit which accurately extracts a target voice and removes noise (background noise and the like) other than the target voice is being developed.

As a technology which in a use environment where noise is present, removes noise and collects a target voice only, there is a technology for providing a microphone unit with directivity. As an example of a microphone unit which has directivity, a microphone unit which is so formed as to allow a sound pressure to act on both surfaces of a diaphragm and generates an electric signal by a vibration of the diaphragm based on a sound pressure difference is conventionally known (e.g., see patent documents 1 and 2).

Incidentally, conventionally, a microphone unit is equipped with an electric circuit portion that processes (e.g., amplification process and the like) an electric signal which is generated based on a vibration of a diaphragm. And, conventionally, this electric circuit portion is disposed outside a sound guide space which extends from a sound hole to the diaphragm (e.g., see FIG. 2 of the patent document 2).

[Patent document 1] JP-A-1992-217199

[Patent document 2] JP-A-2005-295278

SUMMARY OF THE INVENTION

In recent years, miniaturization of a microphone unit is important. Because of this, in a microphone unit which is so formed as to allow a sound pressure to act on both surfaces of the above diaphragm, disposing the electric circuit portion in a sound guide space which extends from a sound hole to the diaphragm has been studied and it is found out that an excellent directional characteristic is not obtained especially in a high-frequency band. In other words, it is found out that in the case where the electric circuit portion is disposed in the sound guide space only for miniaturization, the performance of the microphone unit drops.

Accordingly, it is an object of the present invention to provide a microphone unit which is capable of being miniaturized and has high performance.

To achieve the above object, a microphone unit according to the present invention includes: a housing; a diaphragm which is disposed in the inside of the housing; and an electric circuit portion which processes an electric signal that is generated based on a vibration of the diaphragm. And, in the housing, a first sound guide space which guides a sound outside the housing to a first surface of the diaphragm via a first sound hole and a second sound guide space which guides a sound outside the housing to a second surface, that is, an opposite surface of the first surface of the diaphragm via a second sound hole are formed; the electric circuit portion is disposed in either one of the first sound guide space and the second sound guide space; and an acoustic resistance portion which adjusts at least one of a frequency characteristic of the first sound guide space and a frequency characteristic of the second sound guide space is formed.

According to this structure, a structure is employed, in which the electric circuit portion which performs an amplification process of a signal and the like is disposed in either one of the first sound guide space and the second sound guide space. Accordingly, it is possible to miniaturize the microphone unit compared with the case where the electric circuit portion is disposed outside the sound guide space like the conventional one.

If the electric circuit portion is disposed in the sound guide space, the shapes of the two sound guide spaces (the first sound guide space and the second sound guide space) become imbalanced and the like, which causes generation of a difference between the frequency characteristics of the two sound guide spaces. Specifically, for example, a frequency-characteristic difference occurs in a high-frequency band and excellent noise prevention performance is not obtained in the high-frequency side. In this point, because the present structure has a structure in which the frequency characteristics of the sound guide spaces are adjusted by forming the acoustic resistance portion, it is possible to obtain excellent noise prevention performance in the high-frequency side. In other words, according to the present structure, it is possible to obtain a less-noise and high-quality voice signal (electric signal) which is output from the microphone unit.

In the microphone unit having the above structure, it is preferable that the acoustic resistance portion is so formed as to selectively act on a sound in a specific high-frequency band. The above frequency-characteristic difference between the two sound guide spaces which is generated by disposing the electric circuit portion in the sound guide space is hardly detected in a low-frequency band, for example, and detected in the high-frequency band. Accordingly, by employing the present structure in which the acoustic resistance portion selectively acts on a specific frequency band (e.g., the high-frequency band), it is easy to reduce the frequency-characteristic difference between the two sound guide spaces.

Besides, in the microphone unit having the above structure, the acoustic resistance portion may be formed by mounting an acoustic resistance member on the housing.

As a specific structure which uses the acoustic resistance member, the acoustic resistance member may be so disposed as to block at least part of a route that extends from the first sound hole to the first surface or at least part of a route that extends from the second sound hole to the second surface.

Besides, as another specific structure which uses the acoustic resistance member, the acoustic resistance member may be so disposed as to block at least part of a route that extends from the first sound hole to the first surface and at least part of a route that extends from the second sound hole to the second surface. And, in this case, the acoustic resistance member may include a first acoustic resistance member and a second acoustic resistance member that are separately mounted on the housing.

In the microphone unit having the above structure, at least one of the first sound hole and the second sound hole includes a plurality of through-holes and may double as the acoustic resistance portion.

According to the present invention, it is possible to miniaturize the microphone unit. And, because it is possible to prevent "deterioration in noise prevention performance" which can occur in a case where the miniaturization is achieved, a high-quality voice signal is obtained.

DESCRIPTION OF THE PREFERRED EMBODIMENTS

Hereinafter, embodiments of a microphone unit to which the present invention is applied are described in detail with reference to the drawings.

Figure 1:
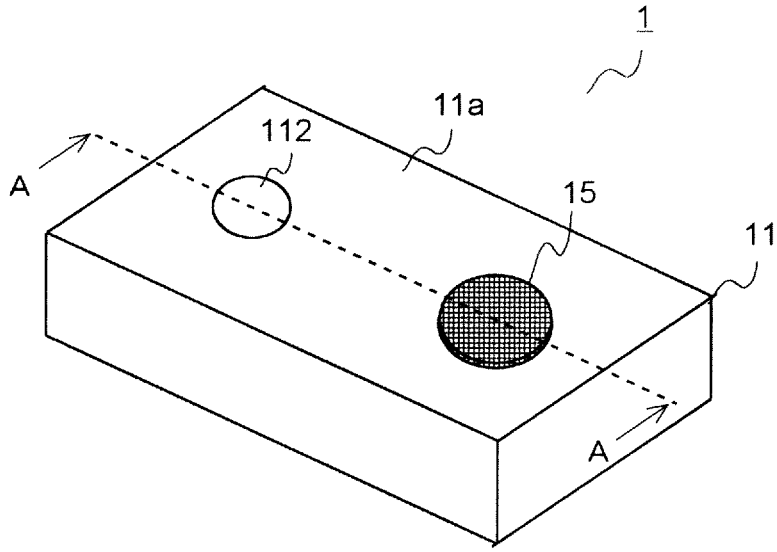
FIG. 1 is a schematic perspective view showing a structure of a microphone unit according to an embodiment.
Figure 2:
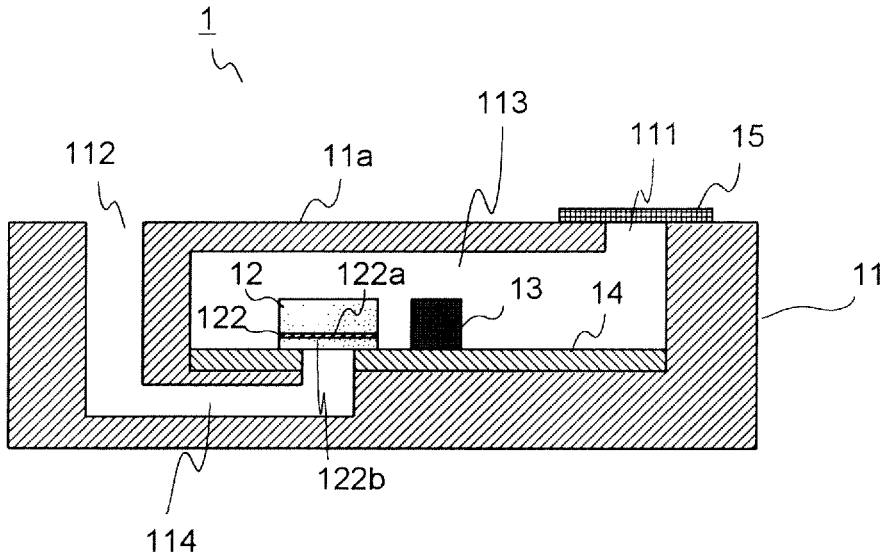
FIG. 2 is a schematic sectional view taken along an A-A position of FIG. 1.

FIG. 1 is a schematic perspective view showing a structure of a microphone unit according to an embodiment. FIG. 2 is a schematic sectional view taken along an A-A position of FIG. 1. As shown in FIGS. 1 and 2, a microphone unit 1 includes: a housing 11; a MEMS (Micro Electro Mechanical System) chip 12; an ASIC (Application Specific Integrated Circuit) 13; a circuit board 14; and an acoustic resistance portion 15.

The housing 11 is formed into substantially a rectangular-parallelopiped shape and houses in the inside thereof: the MEMS chip 12 which includes a vibration membrane (diaphragm) 122; the ASIC 13; and the circuit board 14. Here, the outward form of the housing 11 is not limited to the shape in the present embodiment and may be a cube, for example, nor limited to hexahedrons such as a rectangular parallelopiped and a cube, and may be a polyhedral structure other than hexahedrons or may be a structure (e.g., a spherical structure, a semi-spherical structure or the like) other than polyhedrons.

In the inside of the housing 11, as shown in FIGS. 1 and 2, a first sound guide space 113 and a second sound guide space 114 are formed. The first sound guide space 113 and the second sound guide space 114 are divided by the vibration membrane 122 that the MEMS chip 12 described in detail later includes. In other words, the first sound guide space 113 is in contact with an upper surface (first surface) 122*a* side of the vibration membrane 122 and the second sound guide space 114 is in contact with a lower surface (second surface) 122*b* side of the vibration membrane 122.

Besides, through the upper surface 11*a* of the housing 11, a first sound hole 111 and a second sound hole 112 each of which has substantially a circular shape when seen in a planar fashion are formed. The first sound hole 111 communicates with the first sound guide space 113, and thus the first sound guide space 113 is in a state to communicate with the space outside the housing 11. In other words, a sound outside the housing 11 enters the first sound guide space 113 via the first sound hole 111 and is guided to the upper surface 122*a* of the vibration membrane 122 by the first sound guide space 113. Here, in the present embodiment, although the acoustic resistance portion 15 is formed over the first sound hole 111, a sound wave passes through the acoustic resistance portion 15 and enters the first sound guide space 113 from the space outside the housing 11.

Besides, the second sound hole 112 communicates with the second sound guide space 114, and thus the second sound guide space 114 is in a state to communicate with the space outside the housing 11. In other words, a sound outside the housing 11 enters the second sound guide space 114 via the second sound hole 112 and is guided to the lower surface 122*b* of the vibration membrane 122 by the second sound guide space 114. Here, it is preferable that the distance between the first sound hole 111 and the second sound hole 112 is in a range of about 4 mm to about 6 mm for a purpose of improving the S/N (Signal to Noise) ratio of a voice output from the microphone unit 1 and the like.

In addition, in the present embodiment, although the first sound hole 111 and the second sound hole 112 each have substantially a circular shape when seen in a planar fashion, this is not a limitation, and the shape may be a shape other than the circular shape, or may be a rectangular shape or the like. Further, in the present embodiment, although the number of first sound hole 111 is one and the number of second sound hole 112 is also one, this is not a limitation, that is, a plurality of the first sound holes 111 and a plurality of the second sound holes 112 may be used.

Besides, in the present embodiment, although the first sound hole 111 and the second sound hole 112 are formed on the same plane of the housing 11, this structure is not a limitation, and these sound holes may be formed on different planes, that is, may be formed , for example, on adjacent planes or on planes opposite to each other. Nevertheless, it is preferable that the two sound holes 111, 112 are formed on the same plane of the housing 11, because a sound path in a voice input apparatus (e.g., a mobile phone and the like) which incorporates the microphone unit 1 according to the present embodiment does not become complicated.

Figure 3:
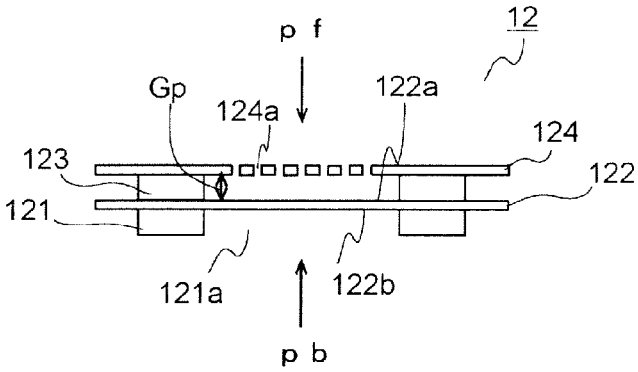
FIG. 3 is a schematic sectional view showing a structure of a MEMS chip which a microphone unit according to an embodiment includes.

FIG. 3 is a schematic sectional view showing a structure of the MEMS chip 12 which the microphone unit 1 according to the present embodiment includes. As shown in FIG. 3, the MEMS chip 12 includes: an insulation base substrate 121; the vibration membrane 122; an insulation membrane 123;

and a fixed electrode 124, and constitutes a capacitor type microphone. Here, the MEMS chip 12 is fabricated by using a semiconductor technology.

For example, an opening 121*a* which has substantially a circular shape when seen in a planar fashion is formed through the base substrate 121, and thus a sound wave which comes from a lower-portion side of the vibration membrane 122 reaches the vibration membrane 122. The vibration membrane 122 formed on the base substrate 121 is a thin film which is vibrated (vibrated in a vertical direction) by a sound wave, has electric conductivity and constitutes one end of an electrode.

The fixed electrode 124 is so disposed as to face the vibration membrane 122 with the insulation membrane 123 interposed therebetween. Thus, the vibration membrane 122 and the fixed electrode 124 form a capacitor. Here, the fixed electrode 124 is provided with a plurality of sound holes 124*a*, so that a sound wave which comes from an upper-portion side of the vibration membrane 122 reaches the vibration membrane 122.

In such MEMS chip 12, when a sound wave enters the MEMS chip 12, a sound pressure pf acts on the upper surface 122*a* of the vibration membrane 122 and a sound pressure pb acts on the lower surface 122*b* of the vibration membrane 122. As a result of this, the vibration membrane 122 vibrates depending on a difference between the sound pressure pf and the sound pressure pb; a gap Gp between the vibration membrane 122 and the fixed electrode 124 changes, so that the electrostatic capacity between the vibration membrane 122 and the fixed electrode 124 changes. In other words, the entering sound wave is drawn out as an electric signal by the MEMS chip 12 which functions as the capacitor type microphone.

Here, in the present embodiment, although the vibration membrane 122 is under the fixed electrode 124, these may be disposed into an inverse relationship (the vibration membrane is over the fixed electrode).

Figure 4:
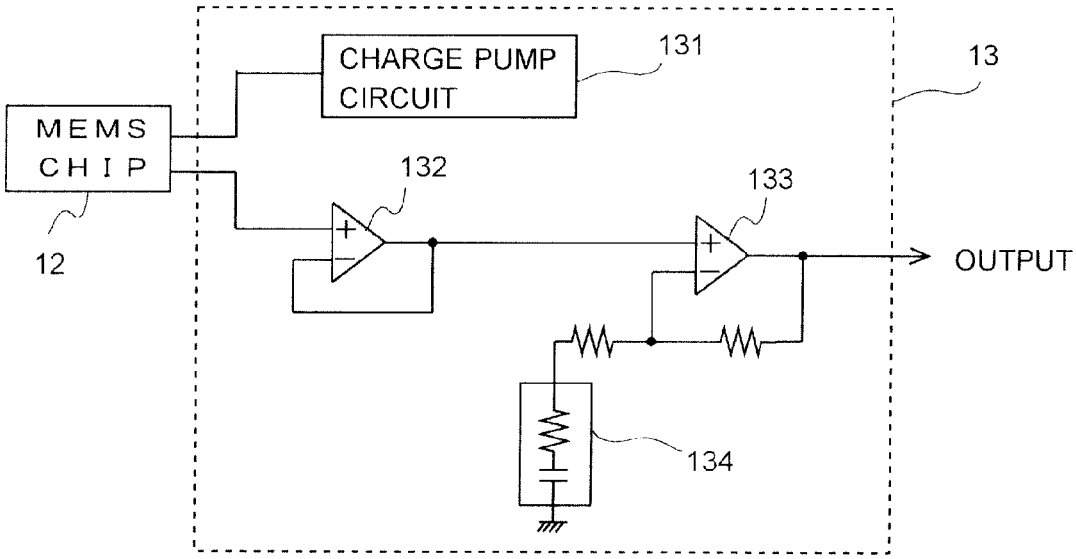
FIG. 4 is a view for describing a circuit structure of an ASIC which a microphone unit according to an embodiment includes.

FIG. 4 is a view for describing a circuit structure of the ASIC 13 which the microphone unit 1 according to the present embodiment includes. The ASIC 13 is an embodiment of an electric circuit portion in the present invention and is an integrated circuit which performs an amplification process with a signal amplification circuit 133 to amplify an electric signal that is generated based on a change in the electrostatic capacity of the MEMS chip 12. In the present embodiment, to accurately capture a change in the electrostatic capacity in the MEMS chip 12, a charge pump circuit 131 and an operational amplifier 132 are included. Besides, a gain adjustment circuit 134 is included, so that it is possible to adjust the amplification factor (gain) of the signal amplification circuit 133. An electric signal amplified by the ASIC 13 is output, for example, to a sound process portion, not shown, on a mount board on which the microphone unit 1 is mounted and processed.

Back to FIG. 2, the circuit board 14 is a board on which the MEMS chip 12 and the ASIC 13 are mounted. In the present embodiment, both MEMS chip 12 and ASIC 13 are mounted by flip-chip bonding and electrically connected to each other by a wiring pattern formed on the circuit board 14. Here, in the present embodiment, although the MEMS chip 12 and the ASIC 13 are mounted by flip-chip bonding, this is not a limitation, and they may be mounted by using wire bonding, for example.

The acoustic resistance portion 15 is formed over the first sound hole 111. In the present embodiment, the acoustic resistance portion 15 is composed of a sheet-shape acoustic resistance member which is formed into substantially a circular shape when seen in a planar fashion and is so disposed as to block the first sound hole 111. As the acoustic resistance member, for example, a mesh member formed of a resin such as polyester, nylon or the like, or a stainless steel or the like is used. The opening of the mesh member is in a range of about 20 μm to about 100 μm, for example, and its thickness is about 0.1 mm, for example. However, these are merely examples, and the opening, the mesh number, the thickness and the like of the mesh member which is used as the acoustic resistance member are suitably changed according to a purpose, and are not limited to the above values. Here, the mesh number refers to the number of meshes that are present per inch (25.4 mm) Besides, the opening refers to a value which is obtained by the following formula in a case where the diameter of a line that constitutes a mesh is defined as a line diameter: the opening (μm)=(25400÷the mesh number)−the line diameter Here, in the present embodiment, the acoustic resistance member which constitutes the acoustic resistance portion 15 is formed into substantially a circular shape when seen in a planar fashion. However, this is not a limitation, and the shape may be suitably changed, that is, may be formed into substantially a rectangular shape or the like, for example, when seen in a planar fashion.

The acoustic resistance portion 15 is so formed as to adjust the frequency characteristic of the first sound guide space 113. This is for reducing a difference between the frequency characteristics of the first sound guide space 113 and the frequency characteristic of the second sound guide space 114. Hereinafter, reasons for why such acoustic resistance portion 15 is formed are described in detail.

Figure 5A:
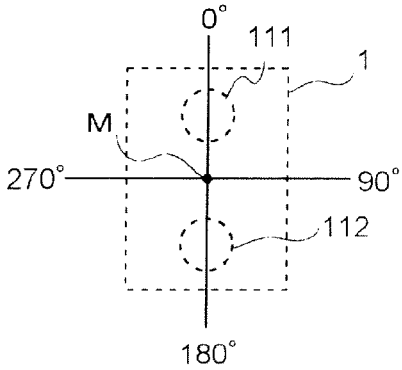
FIG. 5A is a view for describing a directional characteristic which is required for a microphone unit according to an embodiment.
Figure 5B:
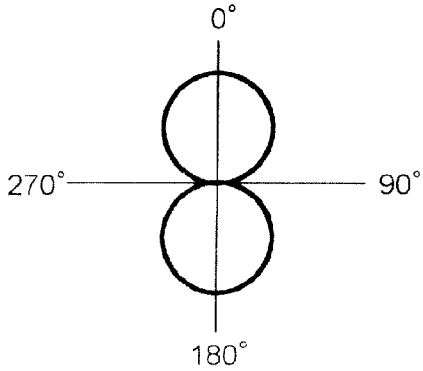
FIG. 5B is a view for describing a directional characteristic which is required for a microphone unit according to an embodiment.

First, with reference to FIGS. 5A and 5B, a directional characteristic which is required for the microphone unit 1 according to the present embodiment is described. Here, as shown in FIG. 5A, a direction which connects the first sound hole 111 and the second sound hole 112 with each other is formed of 0° and 180° directions. Besides, the middle point between the first sound hole 111 and the second sound hole 112 is defined as M.

In this case, as shown in FIG. 5B, assuming that the distance between a sound source and the middle point M is constant, the microphone unit 1 is so required as to allow the sound pressure (pf-pb) acting on the vibration membrane 122 to reach the maximum when the sound source is present in the 0° direction or in the 180° direction. On the other hand, it is required that the sound pressure (pf-pb) acting on the vibration membrane 122 to reach the minimum (0) when the sound source is present in the 90° direction or in the 270° direction. In other words, the microphone unit 1 according to the present embodiment is desired to have a feature (bidirectional characteristic) that the microphone unit 1 easily receives a sound wave which is carried from the 0° and 180° directions and does not easily receive a sound wave which is carried from the 90° and 270° directions. And, symmetry of the directional characteristic shown in FIG. 5B is related to background noise prevention performance and the microphone unit 1 is desired to have a directional characteristic that has excellent symmetry in the entire service frequency range.

Figure 6:
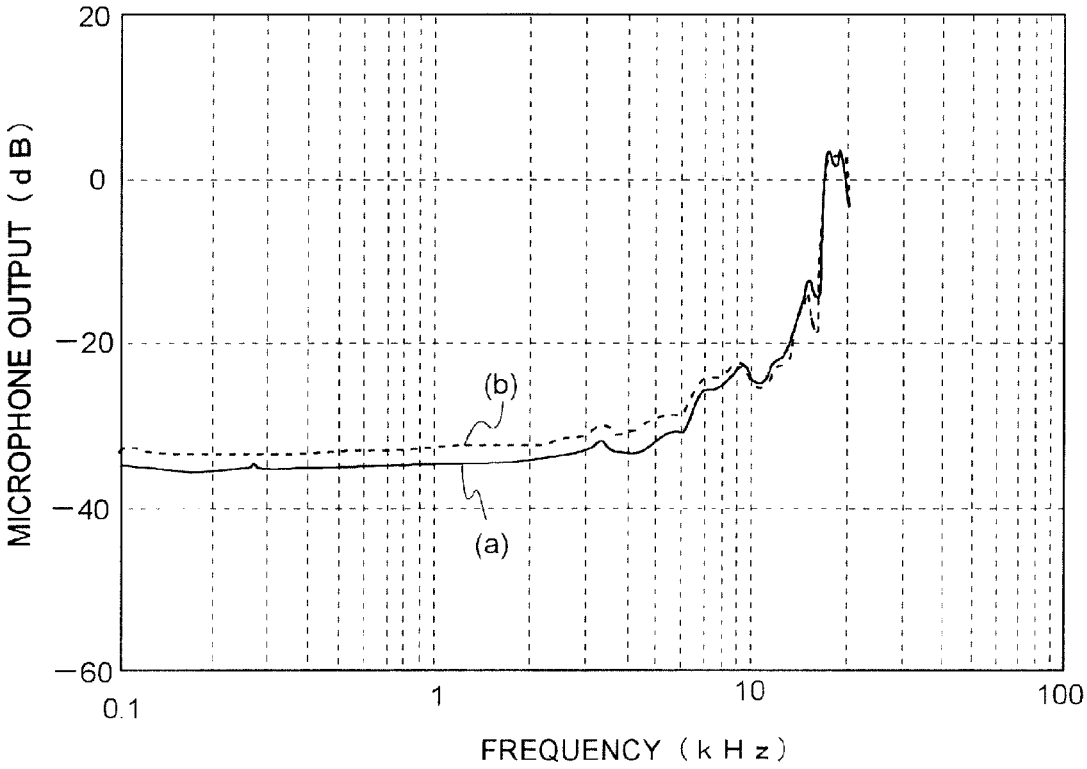
FIG. 6 is a graph for describing a problem in a case of a structure where an acoustic resistance portion is not formed in a microphone unit according to an embodiment.

FIG. 6 is a graph for describing a problem in a case of a structure where the acoustic resistance portion 15 is not formed in the microphone unit 1 according to the present embodiment. In FIG. 6, the horizontal axis (logarithmic axis) is the frequency, and the vertical axis is the output from the microphone. Besides, in FIG. 6, a graph (a) represented by a solid line indicates a frequency characteristic in a case where the acoustic resistance portion 15 is not formed in the microphone unit 1 and a sound wave is inhibited from entering through the second sound hole 112. In addition, in FIG. 6, a graph (b) represented by a broken line indicates a frequency characteristic in a case where the acoustic resistance portion 15 is not formed in the microphone unit 1 and a sound wave is inhibited from entering though the first sound hole 111.

Here, to obtain the data in FIG. 6, the sound source is set at a constant position in a direction which is deviated from the 90° and 270° directions (see FIG. 5A). Besides, the amplitudes (sound pressures) of the sound waves are the same in obtaining the data for each frequency.

Here, assuming that the microphone unit 1 is required to have the bidirectional characteristic shown in FIG. 5B for all the frequencies in the entire service frequency range (e.g, 100 Hz to 10 KHz). In this case, it is required that in the case where a sound wave is carried from the sound source set at a position in the direction deviated from the 90° and 270° directions into the microphone unit 1, a constant output difference is maintained between the graph (a) and the graph (b) in FIG. 6 in the service frequency range even if the frequency changes. Here, the constant output difference is a value which is decided based on a difference between the distance from the sound source to the first sound hole 111 and the distance from the sound source to the second sound hole 112. With regard to this point, in the experimental result shown in FIG. 6, the graph (a) and the graph (b) maintain the constant output difference in a range of about 100 Hz to about 6 kHz. However, the above constant output difference is not maintained in a high-frequency band which exceeds about 6 kHz, and an inverse relationship in the magnitudes of output values between the graph (a) and the graph (b) is also seen.

As a cause of the above tendency in the high-frequency band, there is a cause that the frequency characteristic of the first sound guide space 113 and the frequency characteristic of the first sound guide space 114 are different from each other. In other words, in the microphone unit 1 according to the present embodiment, the ASIC 13 is disposed in the first sound guide space 113 for an aim of miniaturizing the apparatus. Because of this, it is suspected that an imbalance becomes great between the volume of the sound guide space 113 and the volume of the sound guide space 114, so that a difference between the frequency characteristic of the first sound guide space 113 and the frequency characteristic of the second sound guide space 114 occurs. And, it is suspected that the difference between the frequency characteristics is a cause which brings the result shown in FIG. 6. Accordingly, in the microphone unit 1 according to the present embodiment, the frequency characteristic of the first sound guide space 113 is adjusted by forming the acoustic resistance portion 15, so that the difference between the frequency characteristic of the first sound guide space 113 and the frequency characteristic of the second sound guide space 114 is reduced.

As understood from the result shown in FIG. 6, in the microphone unit 1 according to the present embodiment, if the acoustic resistance portion 15 is not formed, a desired bidirectional characteristic (the characteristic shown in FIG. 5B) is obtained in a low-frequency side (a range of frequencies lower than about 6 kHz) while a desired bidirectional characteristic is not obtained in a high-frequency side (a range of frequencies higher than about 6 kHz). To avoid this, it is possible to dispose the acoustic resistance portion 15 which has a function to provide a microphone output represented by a broken line in FIG. 7 in the microphone unit 1. In other words, it is possible to form the acoustic resistance portion 15 which hardly acts on a sound in the low-frequency side and selectively acts on (drops the output in the high-frequency side) a sound in the high-frequency side (e.g, frequencies between 6 kHz and 20 kHz).

Figure 7:
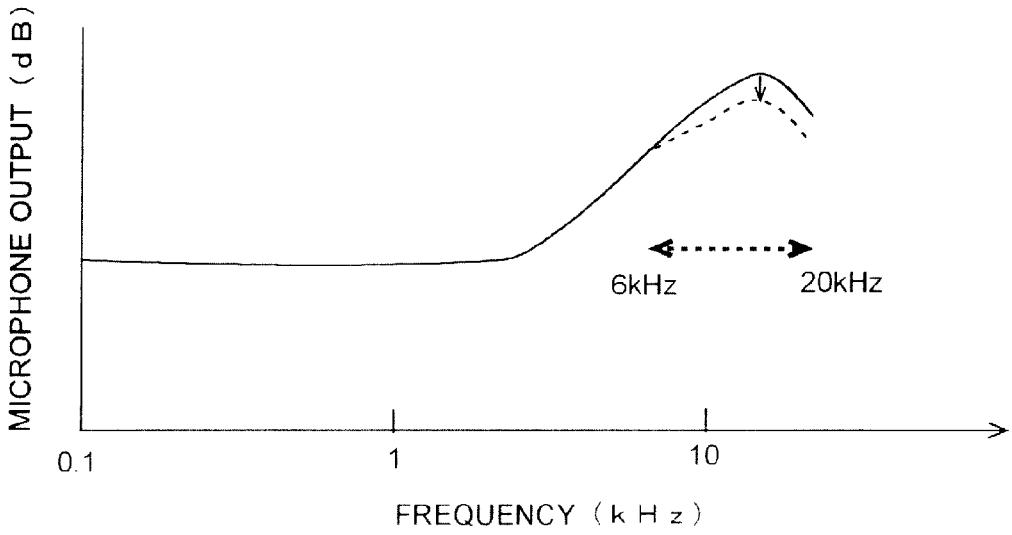
FIG. 7 is a view for describing a characteristic of an acoustic resistance portion which a microphone unit according to an embodiment includes.

Here, FIG. 7 is a view for describing the characteristic of the acoustic resistance portion 15 that the microphone unit 1 according to the present embodiment includes. In FIG. 7, the horizontal axis is a logarithmic axis.

Figure 8:
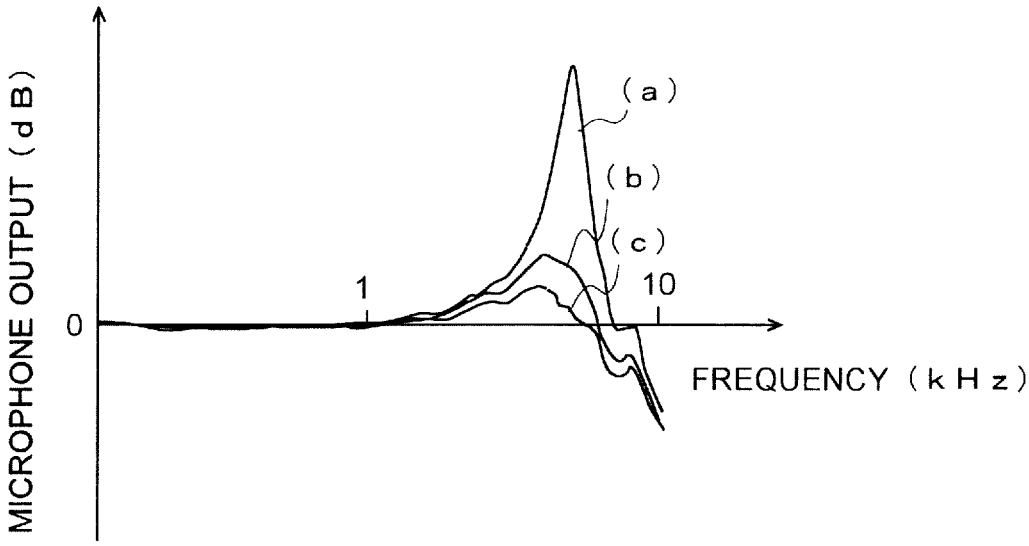
FIG. 8 is a view for describing an effect in a case where an acoustic resistance member is so disposed as to block a sound guide space.

FIG. 8 is a view for describing an effect in a case where an acoustic resistance member is so disposed as to block the sound guide space. In FIG. 8, the horizontal axis (logarithmic axis) is the frequency and the vertical axis is the output from the microphone unit. Besides, in FIG. 8, a graph (a) is a result in a case where an acoustic resistance member is not disposed; a graph (b) is a result in a case where an acoustic resistance member a is disposed; and a graph (c) is a result in a case where an acoustic resistance member b which has a characteristic different from that of the acoustic resistance member a is disposed. Here, although FIG. 8 shows the results in a case where a microphone unit which has a structure different from the structure of the microphone unit 1 is used, the tendency obtained here is also true of the microphone unit 1 according to the present embodiment.

As shown in FIG. 8, it is understood that by disposing the acoustic resistance members a and b to block the sound guide spaces, the microphone output is able to be selectively attenuated in the high-frequency band side without hardly changing the microphone output in the low-frequency band side. Besides, it is also understood that by changing the characteristics of the acoustic resistance members, the attenuation amount of the microphone output for each frequency is able to be changed. Accordingly, it is understood that by so forming the acoustic resistance portion 15 as to block the first sound guide space 113 as in the microphone unit 1 according to the present embodiment, the difference between the frequency characteristic of the first sound guide space 113 and the frequency characteristic of the second sound guide space 114 is able to be reduced.

Here, the main determinants of the characteristic of an acoustic resistance member which is formed of a sheet-shape mesh member are the mesh number (which corresponds to the density of holes formed through the mesh member), the opening (which corresponds to the size of a hole of the mesh member) of the mesh, and the thickness. Accordingly, by adjusting these determinants, it is possible to obtain an acoustic characteristic member which has a desired characteristic.

Here, effects in the case where the microphone unit 1 according to the present embodiment is used are described.

For example, in a case where the microphone unit 1 according to the present embodiment is applied to a close-talking type voice input apparatus, a use's voice is generated from the vicinities of the first sound holes 111 and the second sound hole 112. The user's voice which is thus generated in the vicinity of the vibration membrane 122 has a large sound pressure difference depending on a difference in the distance which extends to the vibration membrane 122. Accordingly, a sound pressure difference is generated by the user's voice between the upper surface 122*a* of the vibration membrane 122 and the lower surface 122*b* of the vibration membrane 122 of the microphone unit 1, so that the vibration membrane 122 vibrates.

On the other hand, as for noise such as background noise and the like, a sound wave appears at a position away from the first sound hole 111 and the second sound hole 112 compared with a user's voice. The noise which thus appears at the position away from the vibration membrane 122 hardly generates a sound pressure difference even if there is a difference in the distance which extends to the vibration membrane 122. Because of this, the sound pressure difference depending on the noise is cancelled by the vibration membrane 122.

Accordingly, in the microphone unit 1, it is possible to consider that the vibration membrane 122 is vibrated by a user's voice only which is near the vibration membrane 122. Because of this, it is possible to consider an electric signal output from the microphone unit 1 as a signal which indicates the user's voice only with the noise removed. In other words, according to the microphone unit 1 in the present embodiment, it is possible to obtain the user's voice with the noise removed. Here, it is preferable that the distance between the first sound hole 111 and the second sound hole 112 is 5 mm or less. As the applicants disclose in JP-A-2008-258904, a ratio of the intensity based on a phase difference component between two sound waves which respectively enter from the first sound hole 111 and the second sound hole 112 and reach the vibration membrane 122 to the intensity of a sound wave which enters from the first sound hole 111 and reaches the vibration membrane 122 or of a sound wave which enters from the second sound hole 112 and reaches the vibration membrane 122 is able to be adjusted to 0 dB or less in an employed frequency band of 100 Hz to 10 kHz, so that it is possible to achieve an excellent background noise suppression function.

Besides, in the microphone unit 1 according to the present embodiment, because the ASIC 13 which processes an electric signal that is generated based on the vibration of the vibration membrane 122 is disposed in the first sound guide space 113, miniaturization of the microphone unit 1 is possible. If the distance between the first sound hole 111 and the second sound hole 112 decreases to 5 mm or less, absolute volumes of the first sound guide space 113 and the second sound guide space 114 also decrease. In such a case, if the ASIC 13 is disposed in one of the sound guide spaces 113 and 114, an imbalance between the volumes occurs, so that a phenomenon easily takes place, in which a difference between the frequency characteristic of the first sound guide space 113 and the frequency characteristic of the second sound guide space 114 occurs.

When the ASIC 13 is disposed in the first sound guide space 113, because of the imbalance between the volume of the first sound guide space 113 and the volume of the second sound guide space 114, the desired bidirectional characteristic is not obtained especially in the high-frequency band, so that excellent noise prevention performance is not obtained. However, in the microphone unit 1 according to the present embodiment, because a difference in the frequency characteristics between the first sound guide space 113 and the second sound guide space 114 is able to be reduced by forming the acoustic resistance portion 15, it is possible to obtain excellent noise prevention performance in the high-frequency side. In other words, it is possible to say that the microphone unit 1 according to the present embodiment is a small-size and high-performance microphone unit.

The above-described embodiments are examples and the microphone unit according to the present invention is not limited to the structures of the above-described embodiments. Various modifications may be made within the scope which does not depart from the object of the present invention.

For example, in the above-described embodiments, the acoustic resistance portion 15 is formed by disposing the acoustic resistance member over the first sound hole 111. However, the acoustic resistance member (the acoustic resistance portion) may be formed at a position through which a sound wave that propagates from the first sound hole 111 to the vibration membrane 122 via the first sound guide space 113 passes. In other words, the acoustic resistance member may be so disposed as to block at least part of the route which extends from the first sound hole 111 to the upper surface 122*a* of the vibration membrane 122. Here, in the present embodiment, the acoustic resistance member blocks all the portions of the route which extends from the first sound hole 111 to the upper surface 122*a* of the vibration membrane 122.

Figure 9:
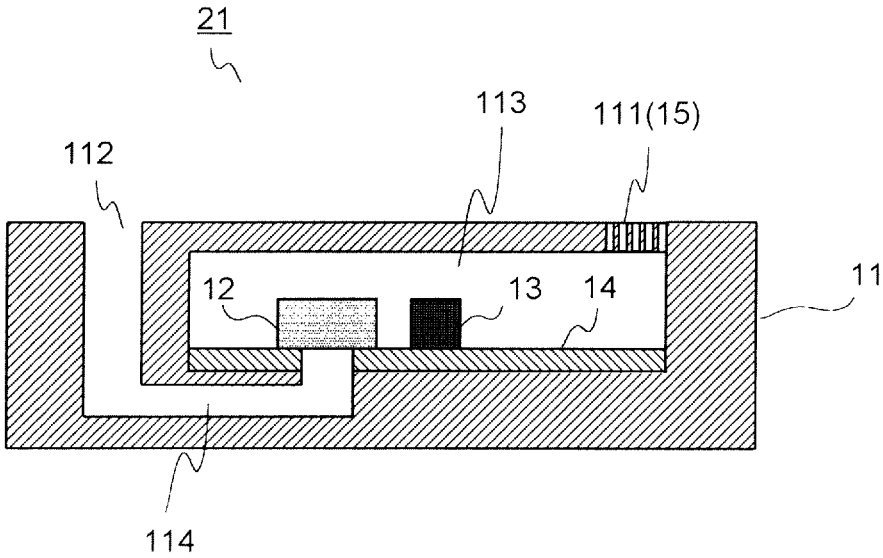
FIG. 9 is a view for describing a modification of a microphone unit according to an embodiment.

Besides, in the above-described embodiments, the acoustic resistance portion 15 is formed by mounting the acoustic resistance member on the housing 11. However, the structure of the acoustic resistance portion 15 is not limited to this, and for example, it may be formed by machining the housing 11. Specifically, for example, as shown in FIG. 9, a microphone unit 21 may have a structure in which the first sound hole 111 is an aggregate of a plurality of small through-holes and the first sound hole 111 doubles the acoustic resistance portion 15.

In addition, in the above-described embodiments, the acoustic resistance portion 15 is formed on only the first sound hole 111 side. However, this is not a limitation, and the acoustic resistance portion may be formed on the second sound hole 112 side as well besides the first sound hole 111 side. In this structure, the acoustic resistance portion is formed, both frequency characteristics of the first sound guide space 113 and the second sound guide space 114 are adjusted, and both frequency characteristics are matched with each other.

Figure 10:
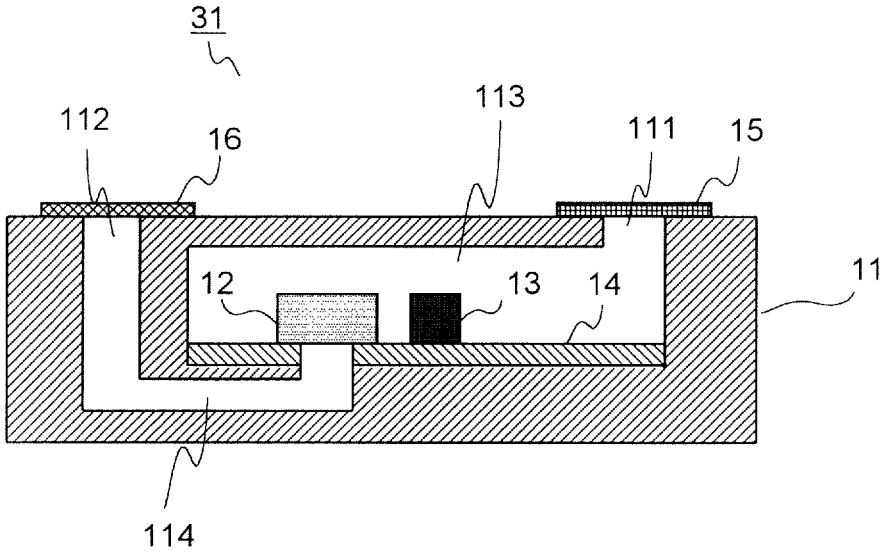
FIG. 10 is a view for describing a modification of a microphone unit according to an embodiment.

As a specific example of the structure in which the acoustic resistance portion is formed on the second sound hole 112 side as well besides the first sound hole 111 side, for example, as shown in FIG. 10, a structure (microphone unit 31) may be employed, in which two acoustic resistance members which have different characteristics are prepared and two acoustic resistance portions 15, 16 are formed. The two acoustic resistance members having different characteristics may be formed of different materials, for example, or may be formed of the same material, with parameters such as a thickness and the like changed.

Figure 11:
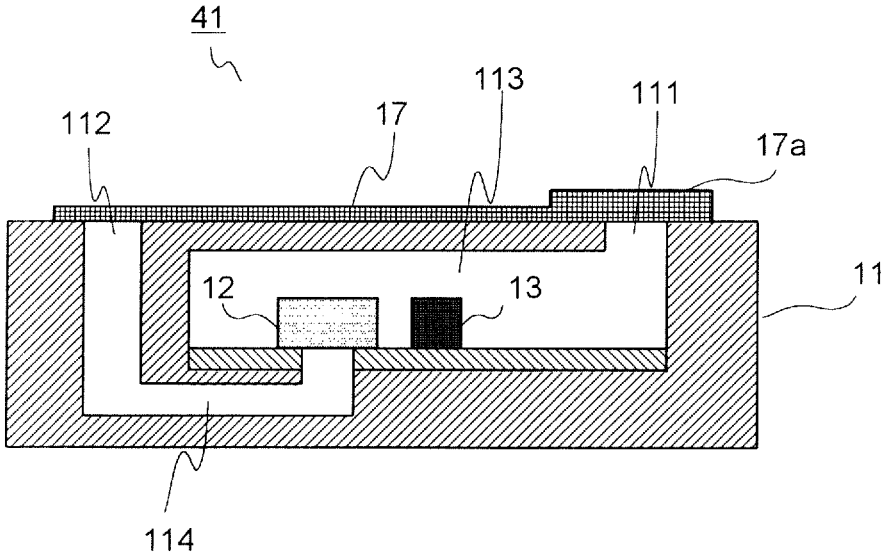
FIG. 11 is a view for describing a modification of a microphone unit according to an embodiment.

As another specific example, as shown in FIG. 11, a structure (microphone unit 41) may be employed, in which the first sound hole 111 and the second sound hole 112 are blocked by only one acoustic resistance member (single member), for example. In this structure, for example, as shown in FIG. 11, a structure may be employed, in which by forming a step portion 17*a*, an acoustic resistance portion 17 is so formed as to have different thicknesses at the first sound hole 111 side and the second sound hole 112 side. Thus, it is possible to reduce a difference between both frequency characteristics by adjusting both frequency characteristics of the first sound guide space 113 and the second sound guide space 114.

Besides, in the above-described embodiments, although the acoustic resistance portion 15 is formed on only the first sound hole 111 side, the acoustic resistance portion 15 may be formed on only the second sound hole 112 side. For example, unlike the present embodiments, if the frequency characteristic of the second sound guide space 114 side is adjusted by changing the space shape of the microphone unit 1, a difference between the frequency characteristic of the first sound guide space 113 and the frequency characteristic of the second sound guide space 114 can be reduced.

In addition, in the above-described embodiments, the structure is employed, in which the vibration membrane 122 (diaphragm) is disposed in parallel with a plane 11*a* through which the sound holes 111, 112 of the housing 11 are formed. However, this structure is not a limitation, and a structure may be employed, in which the diaphragm is not parallel with the plane through which the sound holes of the housing are formed.

Further, in the above-described microphone unit 1, as a structure of the microphone (which corresponds to the MEMS chip 12) which includes the diaphragm, the structure is employed, in which the capacitor type microphone is disposed. However, of course, the present invention is applicable to a microphone unit which includes a microphone other than the capacitor type microphone. As structures other than the capacitor type microphone which includes the diaphragm, there are microphones such as a moving conductor microphone (dynamic type), an electromagnetic microphone (magnetic type), a piezoelectric microphone and the like.

The microphone unit according to the present invention is applicable to voice communication devices such as a mobile phone, a transceiver and the like, voice process systems such as a voice identification system and the like which employ a technology for analyzing an input voice, recording devices and the like.

What is claimed is:

1. A microphone unit that has a bi-directional characteristic, comprising: a housing; a diaphragm which is disposed in the inside of the housing; and an electric circuit portion which processes an electric signal that is generated based on a vibration of the diaphragm; wherein in the housing, a first sound guide space which guides a sound outside the housing to a first surface of the diaphragm via a first sound hole and a second sound guide space which guides a sound outside the housing to a second surface, that is, an opposite surface of the first surface of the diaphragm via a second sound hole are formed; the electric circuit portion is disposed in either one of the first sound guide space and the second sound guide space; and an acoustic resistance portion which adjusts at least one of a frequency characteristic of the first sound guide space and a frequency characteristic of the second sound guide space is formed; wherein the acoustic resistance portion reduces a frequency characteristic difference between the first sound guide space and the second sound guide space, wherein when the acoustic resistance portion adjusts the frequency characteristic of the first sound guide space and the frequency characteristic of the second sound guide space, the acoustic resistance portion shows different functions for the first sound guide portion and the second sound guide portion; wherein the acoustic resistance portion is so formed as to act on a sound in a specific high-frequency band; and wherein the sound in the specific high-frequency band is a sound in a high frequency band of 6 kHz or higher.

2. The microphone unit according to claim 1, wherein the acoustic resistance portion is formed by mounting an acoustic resistance member on the housing.

3. The microphone unit according to claim 1, wherein at least one of the first sound hole and the second sound hole includes a plurality of through-holes and doubles as the acoustic resistance portion.

4. The microphone unit according to claim 1, wherein the acoustic resistance portion is formed by mounting an acoustic resistance member on the housing.

5. The microphone unit according to claim 1, wherein at least one of the first sound hole and the second sound hole includes a plurality of through-holes and doubles as the acoustic resistance portion.

6. The microphone unit according to claim 2, wherein the acoustic resistance member is so disposed as to block at least part of a route that extends from the first sound hole to the first surface or at least part of a route that extends from the second sound hole to the second surface.

7. The microphone unit according to claim 2, wherein the acoustic resistance member is so disposed as to block at least part of a route that extends from the first sound hole to the first surface and at least part of a route that extends from the second sound hole to the second surface.

8. The microphone unit according to claim 4, wherein the acoustic resistance member is so disposed as to block at least part of a route that extends from the first sound hole to the first surface or at least part of a route that extends from the second sound hole to the second surface.

9. The microphone unit according to claim 4, wherein the acoustic resistance member is so disposed as to block at least part of a route that extends from the first sound hole to the first surface and at least part of a route that extends from the second sound hole to the second surface.

10. The microphone unit according to claim 7, wherein the acoustic resistance member includes a first acoustic resistance member and a second acoustic resistance member that are separately mounted on the housing.

11. The microphone unit according to claim 9, wherein the acoustic resistance member includes a first acoustic resistance member and a second acoustic resistance member that are separately mounted on the housing.

* * * * *